United States Patent [19]

Hasenwinkle et al.

[11] Patent Number: 4,633,924

[45] Date of Patent: Jan. 6, 1987

[54] VARIABLE CURVE LINEBAR

[75] Inventors: Earl D. Hasenwinkle, Puyallup; Frank Wislocker, Sumner; Charles Blickenderfer, Puyallup, all of Wash.

[73] Assignee: Weyerhaeuser Company, Tacoma, Wash.

[21] Appl. No.: 793,925

[22] Filed: Nov. 1, 1985

[51] Int. Cl.[4] ..... B27C 1/12

[52] U.S. Cl. ..... 144/242 E; 83/102.1; 83/446; 83/441.1; 144/41; 144/253 H; 144/376; 144/378

[58] Field of Search ..... 83/102.1, 404.1, 404.2, 83/441.1, 449, 64, 367, 371, 378, 376, 732; 144/39, 41, 145 R, 249 A, 242 E, 357, 253 G, 253 H

[56] References Cited

U.S. PATENT DOCUMENTS

| | | | |
|---|---|---|---|
| 259,661 | 6/1882 | Bowker . | |
| 351,303 | 10/1886 | Woods | 144/253 H |
| 1,263,443 | 4/1918 | Lien . | |
| 3,665,984 | 5/1972 | Ackerfeldt | 143/26 A |
| 3,685,556 | 8/1972 | VanSickle | 144/242 R X |
| 4,144,782 | 3/1979 | Lindstrom | 83/102.1 |
| 4,219,056 | 8/1980 | Lindstrom | 143/3 |
| 4,373,563 | 2/1983 | Kenyon | 144/357 |
| 4,416,312 | 11/1983 | Ostberg | 144/39 |

FOREIGN PATENT DOCUMENTS

| | | |
|---|---|---|
| 49-7557 | of 1974 | Japan . |
| 33098 | of 1908 | Sweden . |
| 306415 | of 1968 | Sweden . |
| 545 | of 1852 | United Kingdom . |

*Primary Examiner*—W. D. Bray

[57] ABSTRACT

The present invention is a linebar assembly for guiding a cant or log into a saw. It comprises a flexible linebar which can be bent from a straight-line configuration to one approximating a circular arc having a minimum radius of about 30 m. The linebar can be configured into a circular arc which approximates the curvature of a cant or a log having sweep as great as about 100 mm in 5 m of length. The cant is fed into the saw along a circular path to achieve significantly higher lumber recovery. Extended tests have shown that this recovery will be 20–30% greater than that obtained using conventional straight-line sawing methods without any reduction in grade recovery.

18 Claims, 11 Drawing Figures

VARIABLE CURVE LINEBAR

BACKGROUND OF THE INVENTION

The present invention is a linebar for guiding logs or cants into a saw. It is especially useful for guiding cants which may have variable amounts of sweep into a gang saw in order to increase the recovery of saleable lumber.

Within a few more years, the last of the old growth timber available for harvesting in the United States will have been cut. Most of the sawmills which formerly depended on large old growth logs have already had to convert the equipment in their mills to that which is suitable for handling much smaller logs at high throughput volumes. One common characteristic of second growth timber is that the logs usually have varying but larger amounts of sweep or curvature. The presence of sweep results in yields which are significantly lower than those which are attainable from straight logs. This is because much of the curved portion must be machined off in order to produce cants or lumber having the usual configuration of a rectangular parallelepiped.

Many small log sawmills orient the log prior the primary breakdown saw so that the greatest curvature is either up or down (horns up or horns down) rather than side to side. These opening cuts may be either made by saws or by chippers which reduce the sides of the log to wood chips suitable for pulping. The result is a cant having parallel faces on two sides. As noted earlier, cants sawn in this fashion tend to have appreciable sweep. Sweep is here defined to mean the curvature on the concave edge of the cant when the cant is placed on one of its flat faces. While occasional instances of extreme sweep occur, in most cases sweep is rarely larger than about 100 mm in a cant approximately 5 m long (about 4 in. in 16 ft.). Most typically, it will average between 25 and 50 mm in 5 meters.

Man has had to attempt to cope with geometric irregularities in logs ever since he began to utilize trees. Thus, it is not unexpected that the prior art shows previous attempts to deal with sweepy cants and to devise schemes for improving the yield from cants of this type.

As general background to the present invention, reference can be made to U.S. Pat. Nos. 259,661 to Bowker and 1,263,443 to Lien. Both of these inventors devised schemes for sawing wooden barrel hoops along a path that was precisely parallel to the outside surface of the log. This was deemed necessary in order to reduce the presence of cross grain which would reduce the strength of the hoop. Somewhat more pertinent is Great Britain Pat. No. 545 of 1852. In this sawing device, a tree was placed on a carriage which could be moved in a circular arc with respect to a saw. The purpose here appears to be to cut complex curved and/or angled ships timbers. However, it appears inherent in the invention that cuts could be made parallel to the surface of a curved log.

Japanese Pat. No. 49-7557 shows a device used for "sawing around the curve" of a cant which contains sweep. The cant is first sawn to produce one good edge parallel to the original surface. After this point, additional boards can be taken off parallel to this surface by manually steering the cant as it emerges from the saw.

Swedish Pat. No. 33,098 is a sawing device having feed rolls which can be canted so that the axes lie at an angle and intersect at a point corresponding to the arc of a curve along which a cut is to be made. U.S. Pat. No. 3,685,556 to VanSickle takes a somewhat different approach. This inventor shows a device for use with a shop band saw for cutting predetermined contoured pieces from straight stock to make; e.g., Christmas tree stands. More conventional approaches are described in U.S. Pat. Nos. 3,665,984 to Ackerfeldt, 4,416,312 to Ostberg and Swedish Pat. No. 306,415. These, in general, deal with positioners for optimizing yields from curved cants by straight line sawing. The patent Ackerfeldt is valuable for the background it gives to this type of approach.

While it has been noted that increased yields can be obtained by "sawing around the curve", until very recently nothing has been done to make this a practical approach in a modern, high-speed sawmill. The closest examples can be found in U.S. Pat. Nos. 4,144,782 and 4,219,056 to Lindstrom and U.S. Pat. No. 4,373,563 to Kenyon. The earlier of the two Lindstrom patents is of particular interest. In the device described, a log is fed into what is preferably a single band saw along a path which follows the curvature of the log. The log lies on a roll case with two pairs of opposing vertical guide rollers upstream from the saw. These guide rollers embrace the cant as it is fed into the saw. They are mounted on frames transversely displaceable to the path of the log so that the log is directed along a curve to which the saw blade is tangent. Lindstrom further notes that the bowed boards resulting from around-the-curve sawing will generally flatten out when they are kiln dried. Kenyon shows a somewhat similar system. However, the cant is oriented by lateral pressure applied only to one side of the cant by a roller located upstream from the point of sawing.

To the present inventor's knowledge, the devices taught by Lindstrom and Kenyon have had limited commercial application although their use has not become widespread. This may possibly be because they are of limited use in a high-speed sawmill which may typically run 10–20 cants per minute through a gang saw.

The present invention is a simple solution for around the curve sawing of cants having variable amounts of sweep.

SUMMARY OF THE INVENTION

The present invention is a linebar assembly for guiding a cant or log into a saw. The assembly includes an elongated, flexible linebar which can be configured from a straight-line feed (a circle of infinite radius) to a circular feed having a radius of approximately 30 m. This corresponds to a cant 5 m long having a sweep height of about 100 mm or a 16 ft. long cant having a sweep height of about 4 in. The linebar is positionable so that one end may be attached adjacent to the saw so that a tangent to the end of the linebar at the position of the saw arbor is essentially parallel to the plane containing the saw. A bending device for controlling the curvature of the linebar completes the invention. In use, the curvature of the linebar can be adjusted to give a best fit to the curvature of a cant. The cant can then be guided into the saw along a path approximating its radius of curvature.

In its preferred form, the flexible linebar will comprise a plurality of parallel spring-like strips of gradually decreasing length. One end of all the strips is located at a common position which can be located adjacent to the saw. The other ends of the strips are in a stepped relationship. This assembly is then installed so that the longest strip faces the saw and serves as a contacting and guiding surface for a cant. The saw does not form a part of the present invention. The invention is suitable for use with band saws or circular saws, and with circular gang saws in particular. It could also be used with a sash gang in which a plurality of side-by-side mounted saws are reciprocated.

The linebar assembly will normally include a longitudinal frame member which is mounted essentially parallel to the linebar. This frame may or may not be attached to the saw or to the feeding device for the saw. Normally the bending apparatus will be mounted to operate between the frame member and the flexible linebar. However, a frame member is not essential, as the bending device could be connected at one end to the floor of the sawmill or to any conveniently located existing machinery.

In the preferred form, the linebar will be bendable to approximate an arc of a circle. This configuration is not absolutely essential and, under certain conditions, a slightly different configuration would be acceptable.

There are a number of ways to construct the linebar so that it will achieve the desired arcuate configuration when bent. The decreasing cross-sectional area described in the preferred configuration is only one of them. As one example, a bending force can be applied to the upstream end of a linebar having uniform cross-section and a counter-force can be applied somewhat nearer the saw.

One bending apparatus includes the use of a plurality of spaced-apart bell cranks. These are attached at their central pivot points to the frame member. One arm of the bell cranks is attached to the linebar and the second arm attached to a control means. By central pivot point is meant that general area of the bell crank where the arm members intersect. As used here, the term does not imply any sort of symmetry. When pressure is applied to the bell cranks by the control means, they will rotate about their pivot point and change the curvature of the linebar. Using this method of bending, the length of the arms of the bell crank attached to the linebar should increase as the distance from the saw increases. However, the arms of the bell cranks attached to the control means will all be of essentially identical length.

The assembly just described can be further combined with a translating means to control the offset distance between the linebar and the first or "zero" saw. One way of doing this is to use a second set of bell cranks. The set just described are attached to one arm of the second bell crank set rather than the frame. Instead, the central pivot point of the second set of bell cranks is pivotally mounted to the frame. Rotation of the second set of bell cranks about their central pivot points will control offset while rotation of the first set will control curvature as was previously described.

It is an object of the present invention to provide a linebar for a saw in which the linebar has the capability of being adjusted to varying degrees of curvature.

It is another object to provide a linebar which will enable a sweepy cant to be sawed around the curve in order to increase recovery and lumber yield.

It is a further object to provide a linebar with controllable curvature which can be translated toward or away from the saw to control offset.

It is still another object to provide a linebar with variable curvature which can be simply and relatively inexpensively constructed and installed on existing sawing equipment.

These and many other objects will become readily apparent to those skilled in the art upon reading the following detailed description taken in conjunction with the drawings.

DESCRIPTION OF THE PREFERRED EMBODIMENTS

Figure 1:
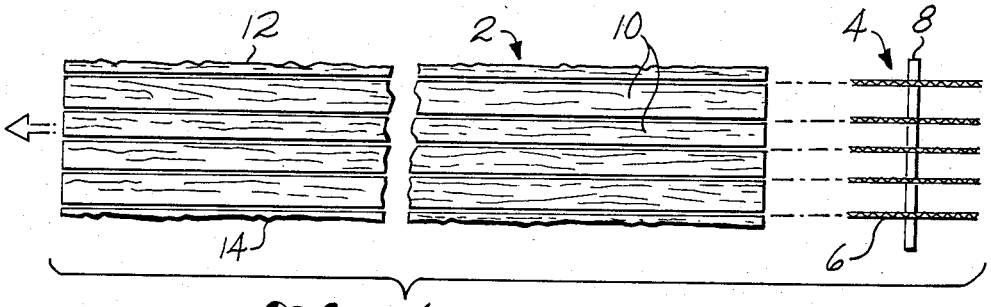
Fig. 1 PRIOR ART
FIG. 1 illustrates a relatively straight cant which has been cut into lumber by conventional straight-line sawing.

The advantages of the present invention will be made readily apparent by reference to FIGS. 1–3. In FIG. 1, a straight cant 2 has just emerged from a circular gang saw 4. This consists of a number of identical circular saws 6 mounted on an arbor 8. To provide a point of reference, the saw to which the numeral 6 is directed should be considered as the first or "zero" saw. Cant 2 has been cut into a number of boards 10 with edge trimmings 12, 14, comprising waste taken from each edge of the cant. Note that four useful pieces of lumber 10 were obtained.

Figure 2:
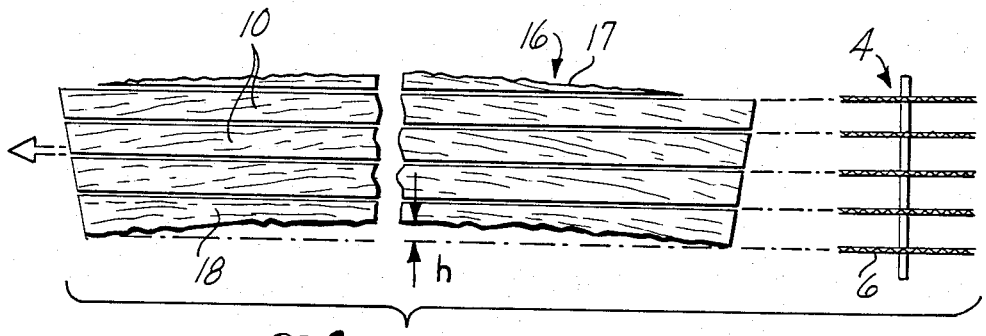
Fig. 2 PRIOR ART
FIG. 2 represents a sweepy cant cut into lumber by straight-line sawing.

In contrast, FIG. 2 shows a sweepy cant 16 which has just been processed in a similar manner through the same set of gang saws 4. Cants 2 and cants 16 are of similar surface area. Here edge trimmings 17, 18 were removed but only three useful pieces of lumber 10 were obtained.

Figure 3:
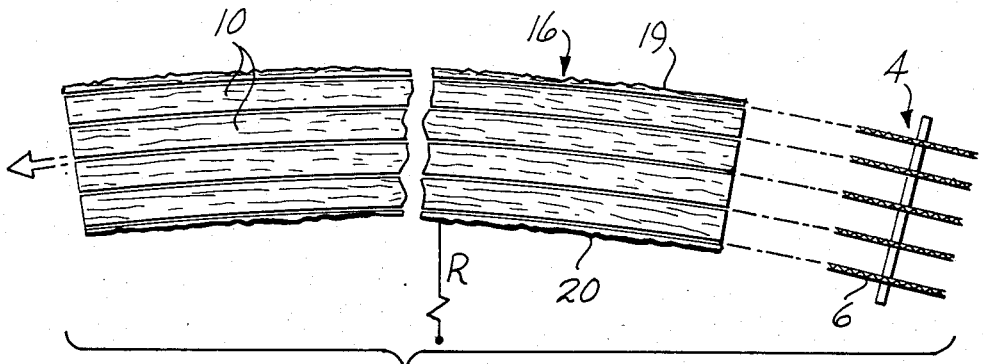
FIG. 3 illustrates a similar sweepy cant cut into lumber by sawing around the curve.

FIG. 3 shows cant 16 as it could be sawed around the curve. In this case, the cant is presented to the saws along a circular path with a radius R. Edge trimmings 19 and 20 generally follow concentric lines parallel to the respective adjacent surfaces. Here, the difference is that four usable pieces of lumber 10 were again obtained. While these are somewhat bowed as they leave the saw, experience has shown that they will normally flatten into a straight configuration during subsequent sawmilling operations, especially when kiln dried.

Figure 4:
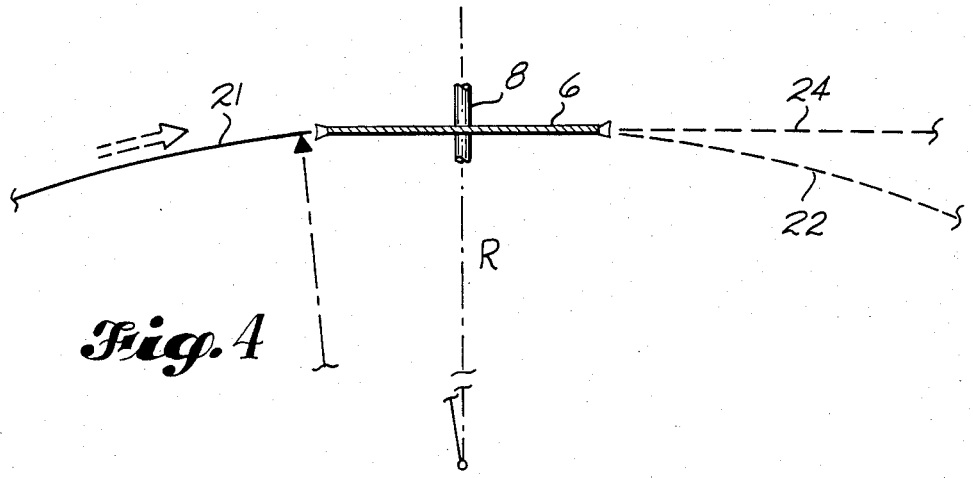
FIG. 4 illustrates the path of a given point on an incoming cant as it approaches and leaves a circular saw during around-the-curve sawing.
Figure 5:
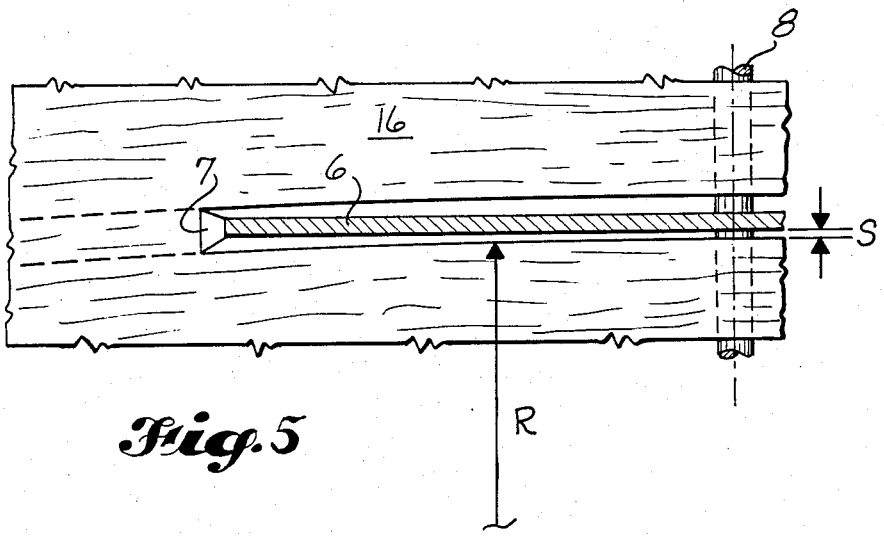
FIGS. 5 and 5A illustrate the relationship of saw side clearance to the present invention.
Figure 5A:
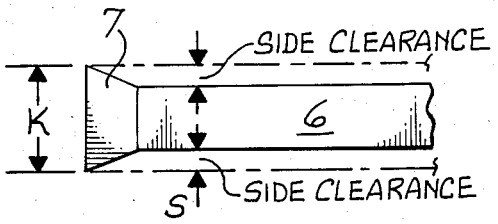

FIGS. 4–5A illustrate one of the limitations to the minimum radius of curvature of sawing. This is in general determined by the available side clearance of the saw. FIG. 4 shows the path of a point on a cant moving into the saw along a circular path 21. Note that this circle is tangent to saw blade 6 at the location of arbor 8. Ideally, one would expect the same point to leave the saw along a similar circular path 22. This is frequently the case when a roll-type conveyor system is used. However, as the lumber leaves the saw, it attains a considerable degree of flexibility not present in the cant entering the saw and it is free to deviate from the "ideal" path 22. In fact, when a slat bed conveyor is used, the exiting lumber will normally assume a nearly straight-line path as shown at 24. As a practical consideration, lumber can be sawn with somewhat more sweep than side clearances would seem to dictate. Some saw plate rubbing does not seem detrimental.

FIG. 5A shows a typical circular saw construction in which the saw plate 6 has swaged or inserted cutting elements 7. These elements describe a path wider than the saw plate itself and cut a kerf K with remaining side clearance s required to prevent frictional rubbing between the material being cut and the side of the saw plate. The permissible radius of curvature R is that as shown in FIG. 5 which will preferably not result in rubbing of cant 16 against the side of the saw plate. It is desirable that some minimum clearance should be maintained at all times.

While there is great variability, the plate thickness of circle saw gang saws will generally vary between 2.4 and 3.4 mm (0.095 to 0.135 in.). Side clearance is typically in the 0.25 to 1.0 mm range (0.010 to 0.040 in.), most typically about 0.4 to 0.5 mm (0.015 to 0.020 in.). This is adequate side clearance to accommodate cants fed along a circular path having a radius of approximately 50 m or greater. This radius corresponds to cants having sweep of approximately 60 mm in a 5 m length or about 3 in. in 16 ft. However, a number of factors will affect the allowable curvature including cant thickness and saw configuration. Decreasing saw diameter also allows curves of shorter radius to be cut. It is believed to be entirely practical to saw around a curve having a radius as short as 30 m. This corresponds to a cant having about 100 mm sweep in 5 m of length or 4 in. in 16 ft. of length.

The following table shows the radius of curvature for cants of varying lengths and sweep distances, where sweep distance is the height of teh arc defining the sweep. These values can be readily calculated for lengths or sweeps not shown on the table using the formula $$R = \frac{1^2 + 4h^2}{8h}$$

where is the length of the cant and h is the sweep distance.

TABLE 1

Radius of Curvature in Meters vs. Sweep for Various Cant Lengths

| | Sweep Distance (h), mm | | | | |
|---|---|---|---|---|---|
| Length (1), m[1] | 20 | 40 | 60 | 80 | 100 |
| 2.5 | 39.1 | 19.6 | 13.1 | 9.8 | 7.8 |
| 3.5 | 76.6 | 38.3 | 25.6 | 19.2 | 15.3 |
| 5 | 156.3 | 78.2 | 52.1 | 39.1 | 31.3 |

[1]These metric lengths correspond roughly to cants 8, 12, and 16 ft. in length.

Figure 6:
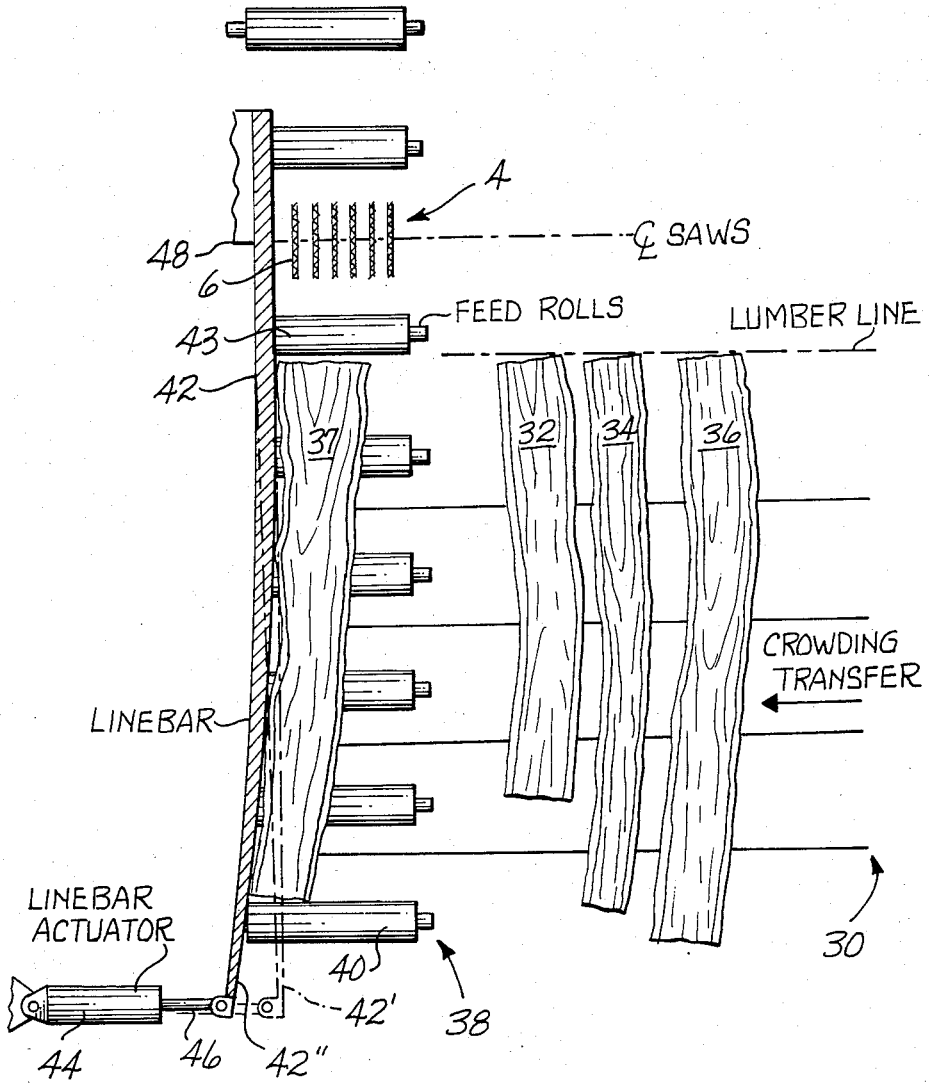
FIG. 6 shows a simple version of the present invention used for feeding cants to a gang saw.

FIG. 6 is an illustration of the construction of the present invention. A cross-transfer mechanism 30 brings cants 32, 34, 36 to be cut into lumber by gang saw 4. Cant 37 is shown in position on an infeed roll case, generally indicated at 38, having driven rolls 40. Cant 37 is presently resting against linebar 42 which has been adjusted to correspond as nearly as is possible to the curvature of the concave edge of the cant. Roll case 38 will carry cant 37 into the gang saw feed rolls 43 where the cant will follow the circular path defined by the configuration of the linebar. The action of roll case 38 will tend to keep cant 37 tightly against the edge of linebar 42 without the need for side rolls or other means for maintaining contact. The sawyer or machine operator can readily adjust the position of linebar 42 through the use of linebar actuator 44 connected to the upstream end of the linebar by piston rod 46. This adjustment can be made visually and using manual control of linebar actuator 44 or it can be done automatically using appropriate sensing elements. Linebar 42 is rigidly anchored at a point 48 where it is tangent to the saws.

As shown in FIG. 6, the surface of linebar 42 contacting the incoming cants is convex in configuration. This configuration is not essential, however. The invention would work equally well if the convex surface of the cant was directed against a concave linebar surface. However, in this case, it would probably be necessary to use side pressure rolls to maintain contact of the cant with the linebar.

Generally speaking, cants with relatively smooth edges will achieve a more optimum fit to the linebar and will usually result in somewhat higher lumber yields. Protrusions such as limb stubs or flared butts may occasionally be responsible for less than optimum fits. Operating experience has shown that this is not a serious problem, however. If desired, a cutter could be installed to remove aberrations of this type.

Figure 7:
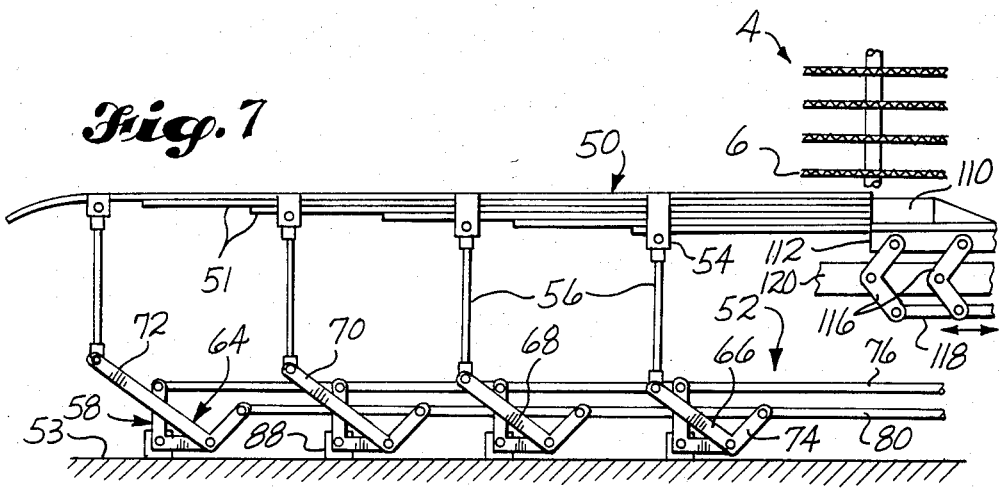
FIGS. 7 and 8 show a version of the present invention adjustable for both curvature and offset.
Figure 8:
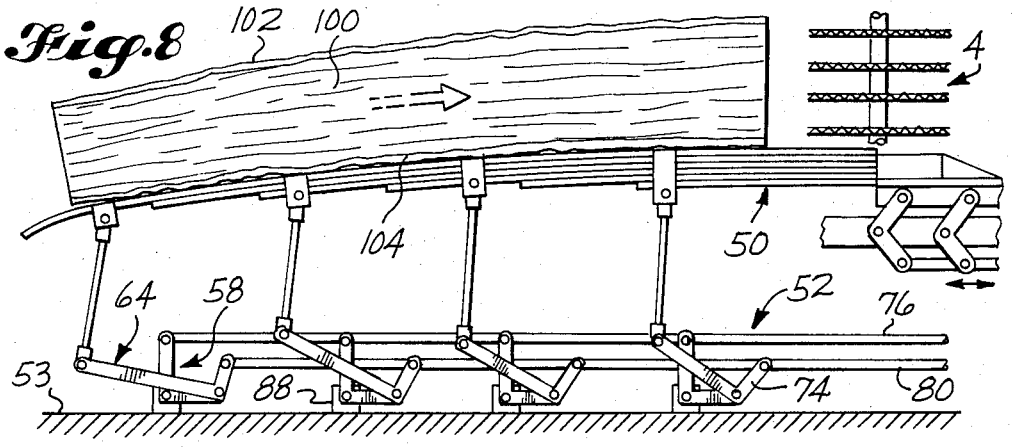
Figure 9:
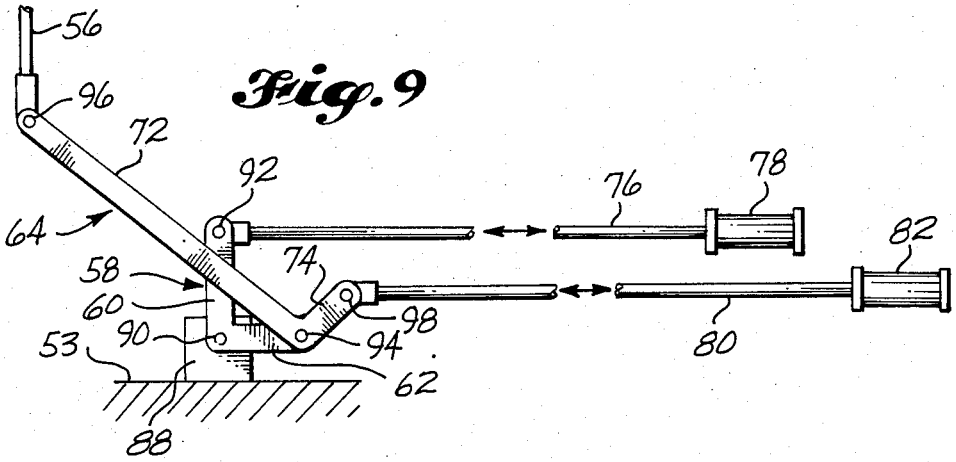
FIG. 9 is a detail of the adjusting mechanism of the embodiment shown in FIGS. 7 and 8.

Reference to FIGS. 7–9 will show the operation of a preferred mode of the present invention. Linebar 50 is seen to be made up of a number of individual spring-like elements 51. This construction in which the cross-sectional area of the linebar increases from the outboard end toward the saw generally tends to result in a bent configuration closely approximating an arc of a circle. FIG. 7 shows the linebar in configuration to feed a straight-sided cant. Curvature and offset can be adjusted by a control mechanism generally shown at 52 mounted to a frame member 53 at attachment points 88.

Reference should now be made to FIG. 9 where the construction and operation of the curvature and offset control mechanism will be explained. This includes a set of first bell cranks for offset control, generally indicated at 58, having first arms 60 and second arms 62. Each member of the first bell crank set is of essentially identical configuration. Operatively connected to the first bell cranks is a set of second bell cranks for curvature control, generally indicated at 64. These have first arms 66, 68, 70, and 72 which increase in length as the distance from the tangent point at the saws is increased. The second bell crank set has second arms 74, all of which are the same length. The first arms 60 of the first bell crank set are each pivotally connected to operating rod 76. This, in turn, is positioned by a hydraulic or pneumatic cylinder 78. In similar fashion, the second arms 74 of the second bell crank set are each pivotally connected to operating rods 80 and control cylinder 82. Cylinder 78 and the first bell crank set control offset, the distance between the linebar and the "zero" saw 6. Cylinder 82 and the second bell crank set control curvature of the linebar. These effects are achieved as follows: the central pivot point 90 of the first bell crank set is attached to mount 88 on frame member 53. First arm 60 is pivotally connected at 92 to operating rod 76. The central pivot point 94 of the second bell crank set is connected to the end of the second arm of the first bell crank set. The first arm members 66, 68, 70, and 72 are pivotally connected at their ends 96 to tie rods 56 which engage shackles 54 on the linebar. The second arms 74 of the second bell crank set are pivotally connected at 98 to operating rods 80.

Linebar 50 must in some way be rigidly anchored at its tangent point in line with the saw arbor since this is the location from which bending occurs. To accommodate this need and still allow offset control, an extension 110 is added to linebar 50. The extension has a flange 112 to which bell cranks 116 are pivotally connected at one end. The other end of bell cranks 116 are pivotally connected to an operating rod 118 which, in turn, is driven by a pneumatic or hydraulic cylinder, not shown. The central pivot points of bell cranks 116 are mounted to a rigidly fixed frame member 120. This may be a part of the saw frame or an extension of frame member 53. Bell cranks 116 are sized and positioned to give equivalent and simultaneous translatory movement to linebar 50 as that given by offset positioning bell crank set 58. The bending and translating mechanisms already described are an example of a type that would be suitable.

Using the above mechanism, linebar curvature and offset can be independently controlled. Offset is adjusted by the rotation of the first bell crank set 58 about pivot points 90. Curvature is adjusted by the rotation of the second bell crank set 64 around pivot points 94.

If it is not deemed necessary to include the feature of offset adjustment in the mechanism, the first bell crank set can be omitted. In this case, the second bell cranks 64 would be directly connected at their central pivot points 94 to mounts 88. Linebar curvature would be controlled as before through the operation of cylinder 82.

FIG. 7 shows the linebar set to direct a straight cant into gang saw 4. However, in FIG. 8 the mechanism has been adjusted to feed cant 100, having wane edges 102, 104 into the gang saw. Note the change in position of the second bell crank set 64 in this figure. While linebar curvature has been changed in FIG. 8, offset has been maintained at the same distance as was shown on FIG. 7.

Figure 10:
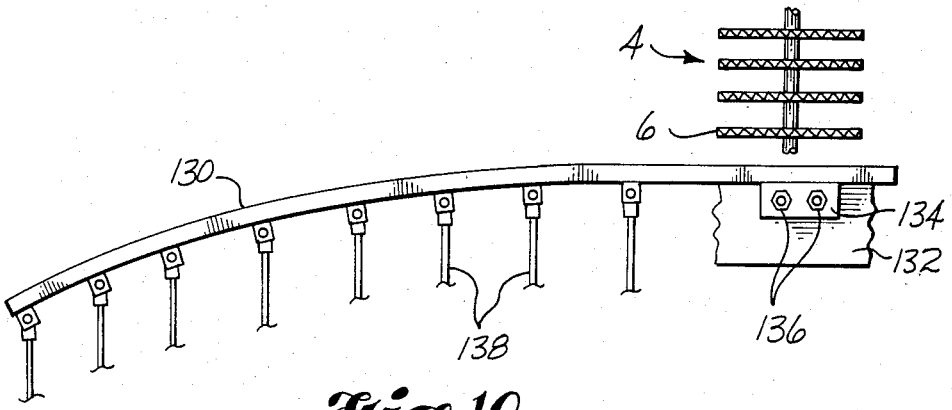
FIG. 10 shows an alternative type of conformable linebar construction.

FIG. 10 shows an alternative form of conformable linebar construction that uses a linebar member of uniform cross-sectional area for its full length. Linebar 130 is secured to a fixed mount 132 by a flange or other means 134 and bolts 136. Multiple positioning means, not shown, are attached to linebar 130 by links 138, only two of which are numbered. These are preferably approximately evenly spaced along the linebar but other spacings can be used as well. The links may be appropriately positioned by either hydraulic or mechanical means which can be constructed or programmed to induce the desired degree of curvature.

EXAMPLE

A linebar capable of being flexed between a straight and a curved configuration was constructed similar to that shown in FIGS. 7–9. The face laminate was 19.1 mm in thickness (¾ in.) and 7.92 m from the upstream end to the point of tangency with the saw. The linebar additionally extended 0.94 m beyond the point of tangency. This was followed by eight laminae, each 12.7 mm in thickness and each being 0.79 m shorter than the previous one. The final lamina was also 19.1 mm in thickness. The height of the assembly was 69.8 mm (2¾ in.). All of the laminae were made of mild steel. Curvature of the linebar was controlled by a hydraulic cylinder. The assembly could be bent to a minimum radius of curvature of about 39 m. Experience has shown that about 98% of the opportunity for increased yield can be achieved within the range of curvature attainable by the linebar. Offset of the device was controlled by a pneumatic step cylinder, variable in 6.3 mm increments between a minimum offset of 12.5 mm and a maximum of 50 mm. Four sets of bell cranks were used for control, in addition to the pair mounted at the saw location.

The above linebar was installed on a circular gang saw and an extended test run using 100 mm (4 in.) cants. Recovery of saleable lumber was approximately 20% greater than was obtained from a control population using straight-line sawing. It was notable that a significantly higher amount of lumber in longer lengths was obtained using the flexible linebar and around-the-curve sawing. No significant amount of residual bow was noted in the test population after kiln drying, nor was there any falldown in grade recovery.

While it is possible to bend a linebar of the above type using a single control mechanism operating at the upstream end, this is not preferred as the laminated construction is subject to hysteresis effects. Recovery is better if bending forces are applied at multiple points along the linebar.

Having thus disclosed the best modes known to the inventors of practicing the present invention, it will be readily apparent to those skilled in the art that many variations can be made without departing from the spirit of the invention. The invention is thus not to be limited to the details disclosed within the description but is to be accorded the full scope of the claims so as to embrace any and all equivalent devices and apparatus.

What is claimed is:

1. A linebar assembly for guiding a cant or log into a saw which comprises an elongated flexible linebar means positionable to that one end is adjacent to the saw, said linebar having a longitudinal axis comformable between a straight line and a line approximating an arc of a circle, the end of the linebar adjacent said saw being positionable so that a tangent to the end is essentially parallel to the plane containing said saw; and bending means for controlling the curvature of said linebar means;

whereby said linebar can be configured into an arc which approximates the curvature of a cant and said cant can be guided into the saw along a path approximating its radius of curvature.

2. The linebar assembly of claim 1 in which the linebar means is of decreasing cross section from the point of tangency to the opposite end.

3. The linebar assembly of claim 2 in which the linebar means comprises a plurality of parallel spring-like strips of gradually decreasing length, one end of all the strips being located at a common position adjacent to the saw, the other ends of the strips being positioned stepwise with the longest of said strips being located so as to face the saw and serve as a cant guiding surface.

4. The linebar assembly of claim 2 which includes a longitudinal frame member essentially parallel to the linebar means and the bending means is mounted to operate between the frame member and linebar means.

5. The linebar assembly of claim 4 which further includes a plurality of spaced apart bell crank means pivotally attached at their central pivot points along the frame member, said bell crank means having first arms operatively connected to the linebar means and second arms pivotally attached to a control means, whereby said bell crank means can be rotated about their central pivot points by the control means to control the curvature of the linebar means.

6. The linebar assembly of claim 5 in which length of the first arms of the bell crank means increases as the distance from the saw increases.

7. The linebar assembly of claim 3 which includes a longitudinal frame member essentially parallel to the linebar means and the bending means is mounted to operate between the frame member and linebar means.

8. The linebar assembly of claim 7 which further includes a plurality of spaced apart bell crank means pivotally attached at their central pivot points along the frame member, said bell crank means having first arms operatively connected to the linebar means and second arms pivotally attached to a control means, whereby said bell crank means can be rotated about their central pivot points by the control means to control the curvature of the linebar means.

9. The linebar assembly of claim 8 in which length of the first arms of the bell crank means increases as the distance from the saw increases.

10. The linebar of claim 1 which further includes translating means for moving the linebar means toward or away from said saw in order to control the offset distance between the saw and the linebar means point of tangency.

11. The linebar assembly of claim 10 in which the linebar means comprises a plurality of parallel spring-like strips of gradually decreasing length, one end of all the strips being located at a common position adjacent to the saw, the other ends of the strips being positioned stepwise with the longest of said strips being located so as to face the saw and serve as a cant guiding surface.

12. The linebar assembly of claim 11 which includes a longitudinal frame member essentially parallel to the linebar means and the bending and translating means is mounted to operate between the frame member and linebar means.

13. The linebar assembly of claim 12 which further includes a plurality of first and second bell crank means each having first and second arms and generally central pivot points, said first bell crank means being spaced apart along and pivotally attached at their central pivot points to the frame member, and having their first arms pivotally attached to a first control means, said second bell crank means being pivotally attached at their central pivot points to the second arms of the first bell crank means, the first arms of the second bell crank means being operatively connected to the linebar means and the second arms being pivotally attached to a second control means, whereby when said first bell crank means are rotated about their central pivot points by the first control means they control offset distance between the linebar means and the saw and when said second bell crank means are rotated about their central pivot points by the second control means they control curvature of the linebar means.

14. The linebar assembly of claim 13 in which length of the first arms of the bell crank means increases as the distance from the saw increases.

15. The linebar of claim 1 in which the linebar means is of uniform cross section for its entire effective length.

16. The linebar of claim 15 further including a plurality of bending means spaced at intervals along the linebar.

17. The linebar of claim 16 which further includes translating means for moving the linebar toward or away from said saw in order to control the offset distance between the saw and the linebar point of tangency.

18. The linebar of claim 1 in which the curvature is variable between a straight line configuration and a curve approximating the arc of a circle having a radius of about 30 m.

* * * * *